US011262172B2

(12) United States Patent
Mannix

(10) Patent No.: US 11,262,172 B2
(45) Date of Patent: Mar. 1, 2022

(54) ENERGY ABSORBING AND SPALL MITIGATING AMMUNITION COMPARTMENT LINER CASSETTE

(71) Applicant: U.S. Army Research Laboratory ATTN: RDRL-LOC-I, Adelphi, MD (US)

(72) Inventor: Gregory S. Mannix, Oxford, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 338 days.

(21) Appl. No.: 15/846,244

(22) Filed: Dec. 19, 2017

(65) Prior Publication Data

US 2019/0186884 A1 Jun. 20, 2019

(51) Int. Cl.

| | |
|---|---|
| ***F42B 39/24*** | (2006.01) |
| ***F41H 5/04*** | (2006.01) |
| ***F41H 5/02*** | (2006.01) |
| ***F42B 39/14*** | (2006.01) |

(52) U.S. Cl.

CPC ..... *F42B 39/24* (2013.01); *F41H 5/023* (2013.01); *F41H 5/04* (2013.01); *F41H 5/0485* (2013.01); *F42B 39/14* (2013.01)

(58) Field of Classification Search

CPC ..... F42B 39/24; F42B 39/26; F42B 39/28; F42B 39/30; F42B 39/14; F42B 39/00; Y10S 224/931; F41H 5/0485; F41H 5/0471; F41H 5/0442; F41H 5/0464; F41H 5/0414; F41H 5/0428; F41H 5/04; F41H 5/02; F41H 5/00; F41H 5/023

USPC ..... 206/3

See application file for complete search history.

(56) References Cited

U.S. PATENT DOCUMENTS

| | | | | | |
|---|---|---|---|---|---|
| 4,989,493 | A * | 2/1991 | Blommer | F42B 39/24 | 102/374 |
| 5,133,258 | A * | 7/1992 | Rock | F42B 39/14 | 102/331 |
| 5,157,223 | A * | 10/1992 | Wheeler | F42B 39/24 | 102/374 |
| 5,158,173 | A * | 10/1992 | Halsey | F42B 39/14 | 206/3 |
| 5,833,782 | A * | 11/1998 | Crane | B32B 5/18 | 156/60 |
| 9,638,496 | B2 * | 5/2017 | Peters | B65D 43/26 | |
| 2004/0006170 | A1 * | 1/2004 | Haftka | C08L 2666/06 | 524/515 |
| 2005/0150781 | A1 * | 7/2005 | Barton | F42B 39/00 | 206/3 |
| 2011/0203475 | A1 * | 8/2011 | Thuman | F42C 15/36 | 102/275.11 |

(Continued)

*Primary Examiner* — Steven A. Reynolds
*Assistant Examiner* — Javier A Pagan
(74) *Attorney, Agent, or Firm* — Alan I. Kalb

(57) ABSTRACT

An ammunition storage compartment includes a plurality of connected walls defining an interior region to store ammunition, wherein at least one of the walls includes an outer armor plate having an outer surface and an inner surface. A layer of energy absorbing material is located proximate the inner surface of the armor plate in the interior region. A spall mitigating panel is located inward of the layer of energy absorbing material in the interior region. At least one air gap is in between the layer of energy absorbing material and the spall mitigating panel.

4 Claims, 9 Drawing Sheets

(56) References Cited

U.S. PATENT DOCUMENTS

2015/0300783 A1* 10/2015 Hunn ..... F41H 5/0492
89/36.02

* cited by examiner

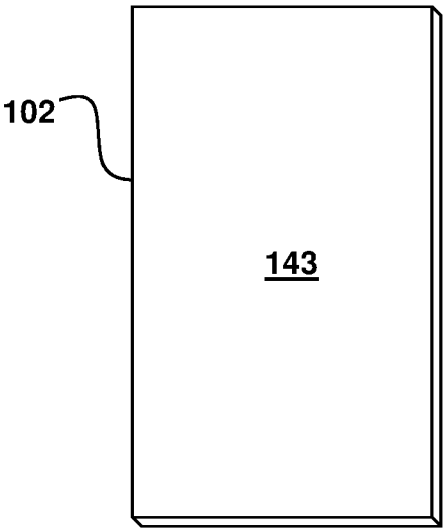
FIG. 4A
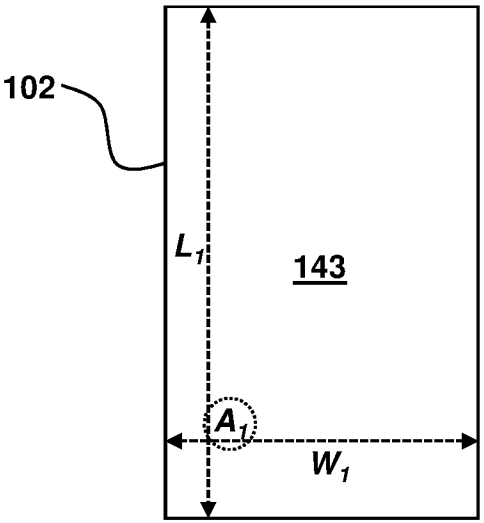
FIG. 4B
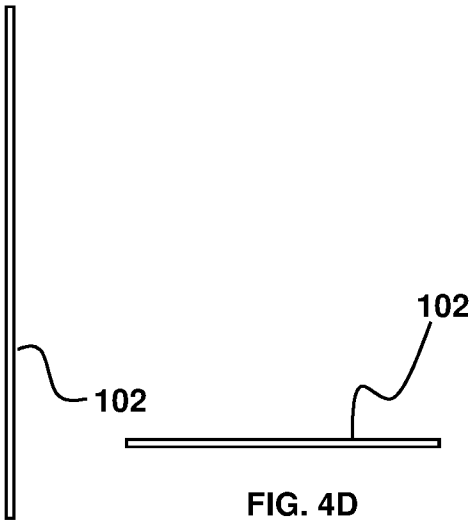
FIG. 4C
FIG. 4D

ENERGY ABSORBING AND SPALL MITIGATING AMMUNITION COMPARTMENT LINER CASSETTE

GOVERNMENT INTEREST

The embodiments described herein may be manufactured, used, and/or licensed by or for the United States Government without the payment of royalties thereon.

BACKGROUND

Technical Field

The embodiments herein generally relate to compartments for ammunition stowage, and more particularly to a system for mitigating the risk of injury or damage resulting from penetration of the compartment by an overmatching threat.

Description of the Related Art

Military vehicles often carry defensive or offensive weapon systems. The ammunition for these weapon systems is often carried in specialized armored compartments. Ammunition stowed in combat vehicles poses a substantial vulnerability when subject to penetrating ballistic impacts. Although ammunition is typically stowed in armor-protected compartments, overmatching threats penetrating the compartment may result in violent ammunition fires, loss of vehicles, and loss of human life.

Large caliber ammunition compartments in existing armor vehicles are located externally relative to the crew compartment and employ blow-off panels. Upon overmatching threat penetration, the blow-off panels effectively release high temperature gases avoiding catastrophic loss of the entire vehicle and occupants. Yet, the stowed ammunition in the compartment is commonly destroyed.

SUMMARY

In view of the foregoing, an embodiment herein provides an ammunition storage compartment comprising a plurality of connected walls defining an interior region to store ammunition, wherein at least one of the walls comprises an outer armor plate having an outer surface and an inner surface; a layer of energy absorbing material located proximate the inner surface of the armor plate in the interior region; a spall mitigating panel located inward of the layer of energy absorbing material in the interior region; and at least one air gap in between the layer of energy absorbing material and the spall mitigating panel. The layer of energy absorbing material may comprise one of a plurality of energy-absorbing layers provided in between the spall mitigating panel and the inner surface of the outer armor plate.

The at least one air gap may be positioned in between one of the plurality of energy-absorbing layers and another panel selected from the plurality of energy-absorbing layers and the spall mitigating panel. The at least one air gap may comprise one of a plurality of air gaps, wherein a respective one of the plurality of air gaps is positioned in between each of the plurality of energy-absorbing layers and a neighboring one of the plurality of energy-absorbing layers and in between the spall mitigating panel and one of the plurality of energy-absorbing layers neighboring the spall mitigating panel. The layer of energy absorbing material may comprise any of high density polyethylene and rubber. The spall mitigating panel may comprise a plate comprising any of an aramid woven fabric and woven laminate encased in a resin.

Another embodiment provides a liner cassette comprising a frame having a first side and a second side, each of the first side and the second side having an inner surface, the frame defining a space between the inner surface of the first side of the frame and the inner surface of the second side of the frame; an energy absorbing layer positioned within the space; and a spall mitigating panel positioned within the space in between the energy absorbing layer and the second side.

The liner cassette may further comprise an air gap positioned in between the energy absorbing layer and the spall mitigating panel. The energy absorbing layer may comprise one of a plurality of energy absorbing layers positioned within the space in between the spall mitigating panel and the first side of the frame. The liner cassette may further comprise at least one air gap positioned in between one of the plurality of energy absorbing layers and another panel selected from the plurality of energy absorbing layers and the spall mitigating panel. The frame may define a first opening on the first side of the frame and a second opening on the second side of the frame such that the first opening is in registry with the second opening, wherein a first energy absorbing layer of the plurality of energy absorbing layers is positioned adjacent the first opening, wherein the spall mitigating panel is positioned adjacent the second opening, and wherein the plurality of energy absorbing layers, other than the first energy absorbing layer, are placed in between the first energy absorbing layer and the spall mitigating panel.

The liner cassette may further comprise an air gap positioned in between each of the plurality of energy absorbing layers and a neighboring one of the plurality of energy absorbing layers and in between the spall mitigating panel and one of the plurality of energy absorbing layers neighboring the spall mitigating panel. Each of the plurality of energy absorbing layers may comprise a frontal area larger than the first opening and the spall mitigating panel comprises a frontal area larger than the second opening. Each of the plurality of energy absorbing layers and the spall mitigating panel may comprise a frontal area larger than the first opening and larger than the second opening. The frame may comprise an approximately U shaped cross section formed by approximately parallel lateral walls, each wall having an outer perimeter, and a bottom plate extending generally perpendicularly to the lateral walls, and wherein the plurality of energy absorbing layers and the spall mitigating panel are positioned in between the lateral walls. The energy absorbing layer may comprise any of high density polyethylene and rubber. The spall mitigating panel may comprise a plate comprising any of an aramid woven fabric and woven laminate encased in a resin.

In an embodiment, a sum defined by the added thicknesses of all of the plurality of energy absorbing panels and of the spall mitigating panel may be less than a dimension of the space between the inner surface of the first side of the frame and the inner surface of the second side of the frame, and wherein at least one of the plurality of energy absorbing panels is held loosely within the frame such that the at least one of the plurality of energy absorbing panels is configured to move relative to the frame in at least one direction in response to an impact by a fragment having a component of velocity in the at least one direction.

In another embodiment, a sum defined by the added thicknesses of all of the plurality of energy absorbing panels and of the spall mitigating panel may be less than a dimension of the space between the inner surface of the first side of the frame and the inner surface of the second side of the frame, wherein the frame defines a first opening on the first side of the frame and a second opening on the second side of the frame such that the first opening is in registry with the second opening, wherein a first energy absorbing panel of the plurality of energy absorbing panels is positioned adjacent the first opening, wherein the spall mitigating panel is positioned adjacent the second opening, wherein the plurality of energy absorbing panels, other than the first energy absorbing panel, are placed in between the first energy absorbing panel and the spall mitigating panel, and wherein at least the plurality of energy absorbing panels, other than the first energy absorbing panel, are held loosely within the frame such that at least the plurality of energy absorbing panels, other than the first energy absorbing panel, are configured to move relative to the frame. The plurality of energy absorbing panels may be held loosely within the frame such that the plurality of energy absorbing panels are configured to move relative to the frame.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which:

FIG. 4A is a perspective view of an energy-absorbing layer, according to an embodiment herein;

FIG. 4B is a front or rear view of the energy-absorbing layer of FIG. 4A, according to an embodiment herein;

FIG. 4C is a side view of the energy-absorbing layer of FIG. 4A, according to an embodiment herein;

FIG. 4D is a top or bottom view of the energy-absorbing layer of FIG. 4A, according to an embodiment herein;

DETAILED DESCRIPTION

Figure 1:
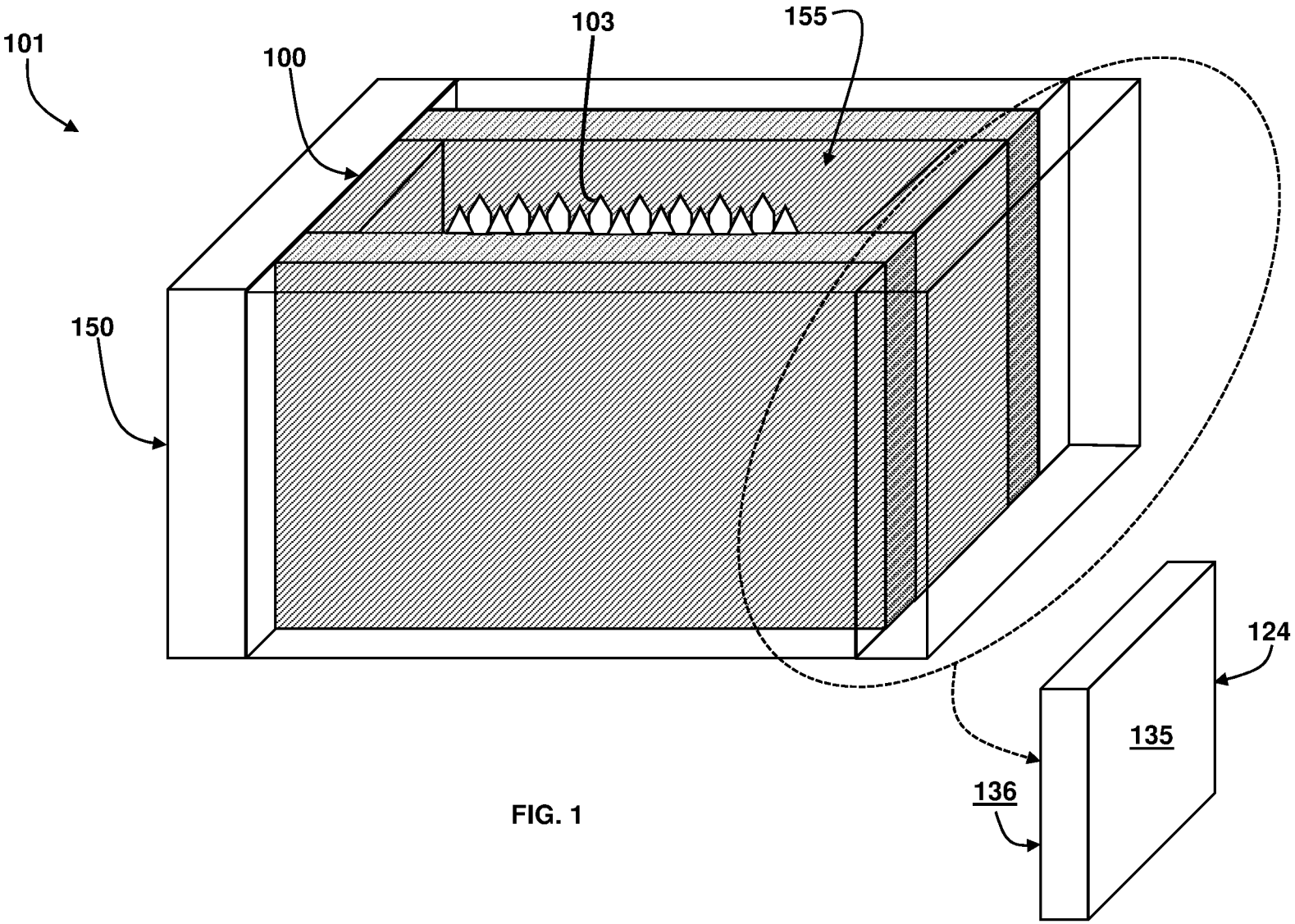
FIG. 1 is a perspective view of an ammunition compartment, according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Ammunition stowed in combat vehicles poses a substantial vulnerability when subject to penetrating ballistic impacts. Although ammunition is typically stowed in armor-protected compartments, overmatching threats penetrating the compartment may result in violent ammunition fires, loss of vehicles, and loss of human life. In particular, combat vehicles in threat environments have the potential to be affected by overmatching penetrating threats; e.g., shaped-charge jets embodied in rocket-propelled grenades or anti-tank guided missiles. In the event of an ammunition compartment incident, stowed ammunition typically responds in a violent energetic reaction potentially destroying all stowed ammunition resulting in loss of ammunition, vehicle and occupant crew. Stowed ammunition on the shaped-charge jet shotline will be affected by the jet. Whereas, the non-shotline stowed ammunition are damaged and react in response to spall fragment and ricochet. Ammunition stowed in existing combat vehicles are protected by external armor. In the event of overmatching threat penetration, the ammunition is not protected resulting in catastrophic loss to the ammunition, vehicle and occupants. The embodiments herein provide an energy absorbing and spall mitigating ammunition compartment cassette liner system. The embodiments herein significantly improve stowed ammunition survivability by absorbing and mitigating spall fragment ricochet effectively reducing the quantity of rounds responding with a violent reaction.

Referring now to the drawings, and more particularly to FIGS. 1 through 12, where similar reference characters denote corresponding features consistently throughout the figures, there are shown exemplary embodiments. In the descriptions provided herein, reference is made to various dimensions, shapes, and materials for the purposes of providing example approximate configurations of the various components. All given dimensions are example approximate dimensions, and all described shapes and materials are examples. However, the embodiments herein are not restricted to these particular dimensions, shapes, or materials.

Referring to FIGS. 1 through 12, one of the examples disclosed herein is an energy-absorbing and spall-mitigating ammunition compartment liner cassette 100 that will substantially improve ammunition, combat vehicle, and crew or occupant survivability.

Figure 2:
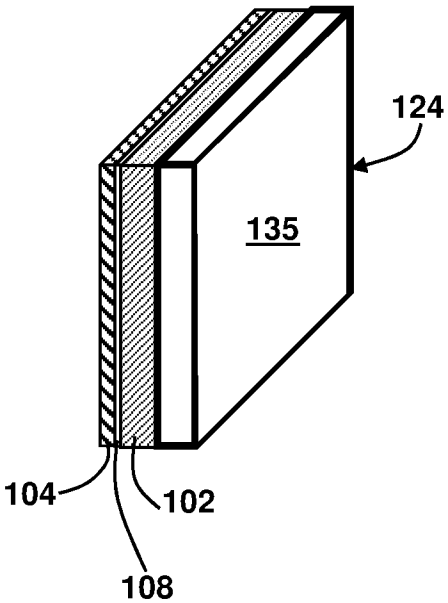
FIG. 2 is a perspective view of an energy-absorbing layer and spall-mitigating layer adjacent to an armor plate of the ammunition compartment of FIG. 1, according to an embodiment herein.
Figure 5A:
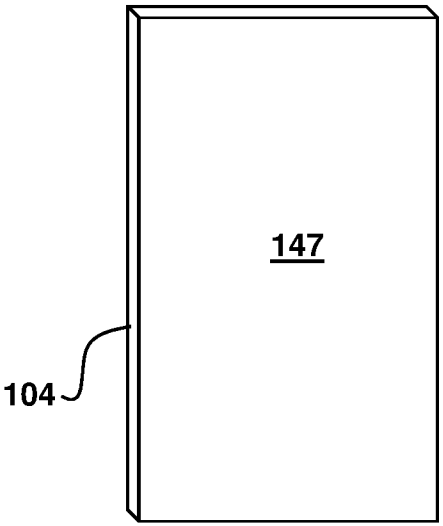
FIG. 5A is a perspective view of a spall-mitigating panel, according to an embodiment herein.
Figure 5B:
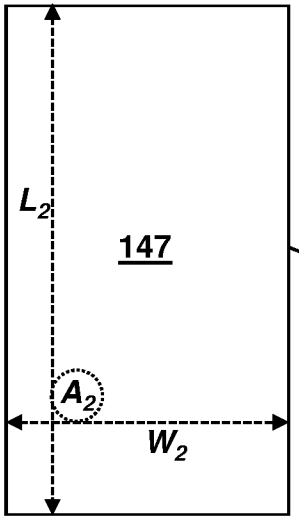
FIG. 5B is a front or rear view of the spall-mitigating panel of FIG. 5A, according to an embodiment herein.
Figure 5C:
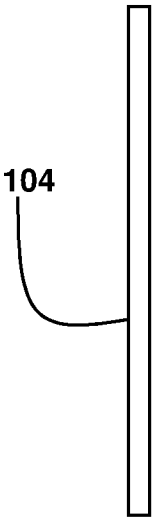
FIG. 5C is a side view of the spall-mitigating panel of FIG. 5A, according to an embodiment herein.
Figure 5D:
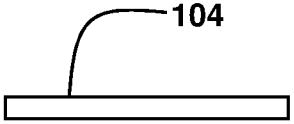
FIG. 5D is a top or bottom view of the spall-mitigating panel of FIG. 5A, according to an embodiment herein.

FIG. 1 illustrates an ammunition storage compartment 101 comprising a plurality of connected walls 150 defining an interior region 155 to store ammunition 103, wherein at least one of the walls comprises an outer armor plate 124 having an outer surface 135 and an inner surface 136. A layer 102 of energy absorbing material is located proximate the inner surface 136 of the armor plate 124 in the interior region 155, and a spall-mitigating panel 104 is located inward of the layer 102 of energy absorbing material in the interior region 155. FIG. 2, with reference to FIG. 1, shows the layer 102 adjacent to the armor plate 124. The layer 102 may be directly touching the armor plate 124 or may be offset by a predetermined distance away from the armor plate. At least one air gap 108 is configured in between the layer 102 of energy absorbing material and the spall-mitigating panel 104.

Figure 3:
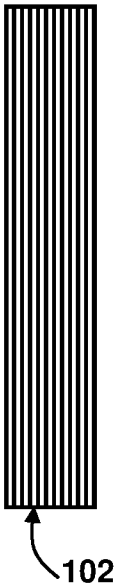
FIG. 3 is a top view of a plurality of energy-absorbing layers, according to an embodiment herein.

The layer 102 of energy absorbing material may comprise one of a plurality of energy-absorbing layers 102 provided in between the spall-mitigating panel 104 and the inner surface 136 of the outer armor plate 124. FIG. 3, with reference to FIGS. 1 and 2, illustrate that the layer 102 of energy absorbing material may comprise a plurality of energy-absorbing layers 102. The at least one air gap 108 is positioned in between one of the plurality of energy-absorbing layers 102 and another panel selected from the plurality of energy-absorbing layers 102 and the spall-mitigating panel 104. The at least one air gap 108 may comprise one of a plurality of air gaps 108, wherein a respective one of the plurality of air gaps 108 is positioned in between each of the plurality of energy-absorbing layers 102 and a neighboring one of the plurality of energy-absorbing layers 102 and in between the spall-mitigating panel 104 and one of the plurality of energy-absorbing layers 102 neighboring the spall-mitigating panel 104. The layer 102 of energy-absorbing material may comprise any of high density polyethylene and rubber. The spall-mitigating panel 104 may comprise a plate comprising any of an aramid woven fabric and woven laminate encased in a resin.

FIGS. 4A through 4D, with reference to FIGS. 1 through 3, illustrate various views of the layer 102 of energy absorbing. The layer 102 may comprise a substantially planar surface 143 on all sides of the layer 102 including the front, rear, left-side, right-side, top, and bottom. The layer 102 comprises a length $L_1$ and a width $W_1$ defining a first frontal area $A_1$. FIGS. 5A through 5D, with reference to FIGS. 1 through 4D, illustrate various views of the spall-mitigating panel 104. The panel 104 may comprise a substantially planar surface 147 on all sides of the panel 104 including the front, rear, left-side, right-side, top, and bottom. The panel 104 comprises a length $L_2$ and a width $W_2$ defining a second frontal area $A_2$.

Figure 6:
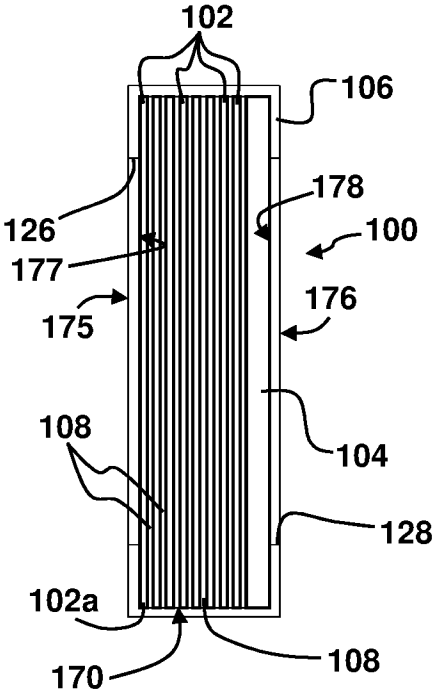
FIG. 6 is a cross-sectional view of a frame containing an energy-absorbing layer and a spall-mitigating panel, according to an embodiment herein.

FIG. 6, with reference to FIGS. 1 through 5D, illustrates a frame 106 having a first side 175 and a second side 176, each of the first side 175 and the second side 176 having an inner surface 178. The frame 106 defines a space 170 between the inner surface 177 of the first side 175 of the frame 106 and the inner surface 178 of the second side 176 of the frame 106, wherein the energy-absorbing layer 102 is positioned within the space 170, and the spall-mitigating panel 104 is positioned within the space 170 in between the energy-absorbing layer 102 and the second side 176.

The frame 106 defines a first opening 126 on the first side 175 of the frame 106 and a second opening 128 on the second side 176 of the frame 106 such that the first opening 126 is in registry with the second opening 128, wherein a first energy-absorbing layer 102*a* of the plurality of energy-absorbing layers 102 is positioned adjacent the first opening 126, wherein the spall-mitigating panel 104 is positioned adjacent the second opening 128, and wherein the plurality of energy-absorbing layers 102, other than the first energy-absorbing layer 102*a*, are placed in between the first energy-absorbing layer 102*a* and the spall-mitigating panel 104.

Each of the plurality of energy-absorbing layers 102 comprises a frontal area $A_1$ larger than the first opening 126 and the spall-mitigating panel 104 comprises a frontal area $A_2$ larger than the second opening 128. Moreover, each of the plurality of energy-absorbing layers 102 and the spall-mitigating panel 104 comprises a frontal area $A_1$, $A_2$ larger than the first opening 126 and larger than the second opening 128.

A sum defined by the added thicknesses of all of the plurality of energy-absorbing layers 102 and of the spall-mitigating panel 104 is less than a dimension of the space 170 between the inner surface 177 of the first side 175 of the frame 106 and the inner surface 178 of the second side 176 of the frame 106, and wherein at least one of the plurality of energy-absorbing layers 102 is held loosely within the frame 106 such that the at least one of the plurality of energy-absorbing layers 102 is configured to move relative to the frame 106 in at least one direction in response to an impact by a fragment 105 having a component of velocity in the at least one direction.

At least the plurality of energy-absorbing layers 102, other than the first energy-absorbing layer 102*a*, are held loosely within the frame 106 such that at least the plurality of energy-absorbing layers 102, other than the first energy-absorbing layer 102*a*, are configured to move relative to the frame 106. The plurality of energy-absorbing layers 102 may be held loosely within the frame 106 such that the plurality of energy-absorbing layers 102 are configured to move relative to the frame 106.

Figure 8:
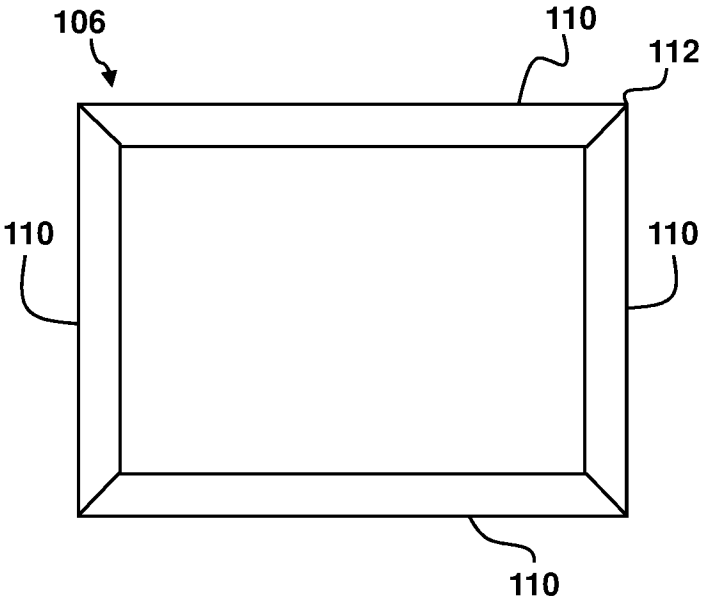
FIG. 8 is front view of the frame, according to an embodiment herein.
Figure 7:
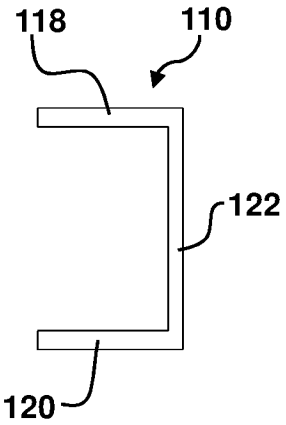
FIG. 7 is a cross-sectional view of frame members; according to an embodiment herein.
Figure 9B:
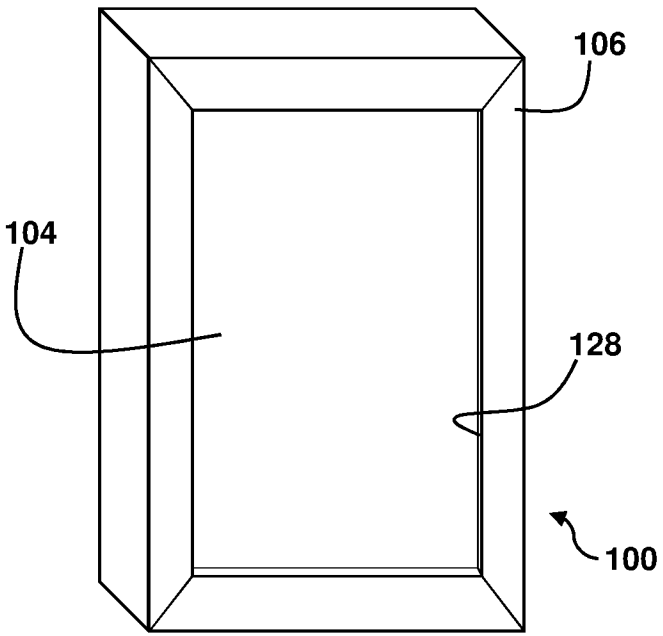
FIG. 9B is a second perspective view of the frame, according to an embodiment herein.
Figure 9A:
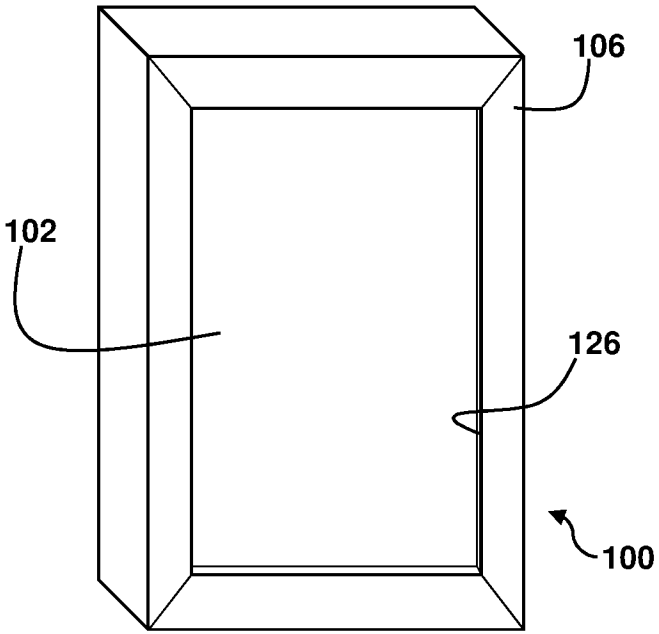
FIG. 9A is a first perspective view of the frame, according to an embodiment herein.
Figure 9C:
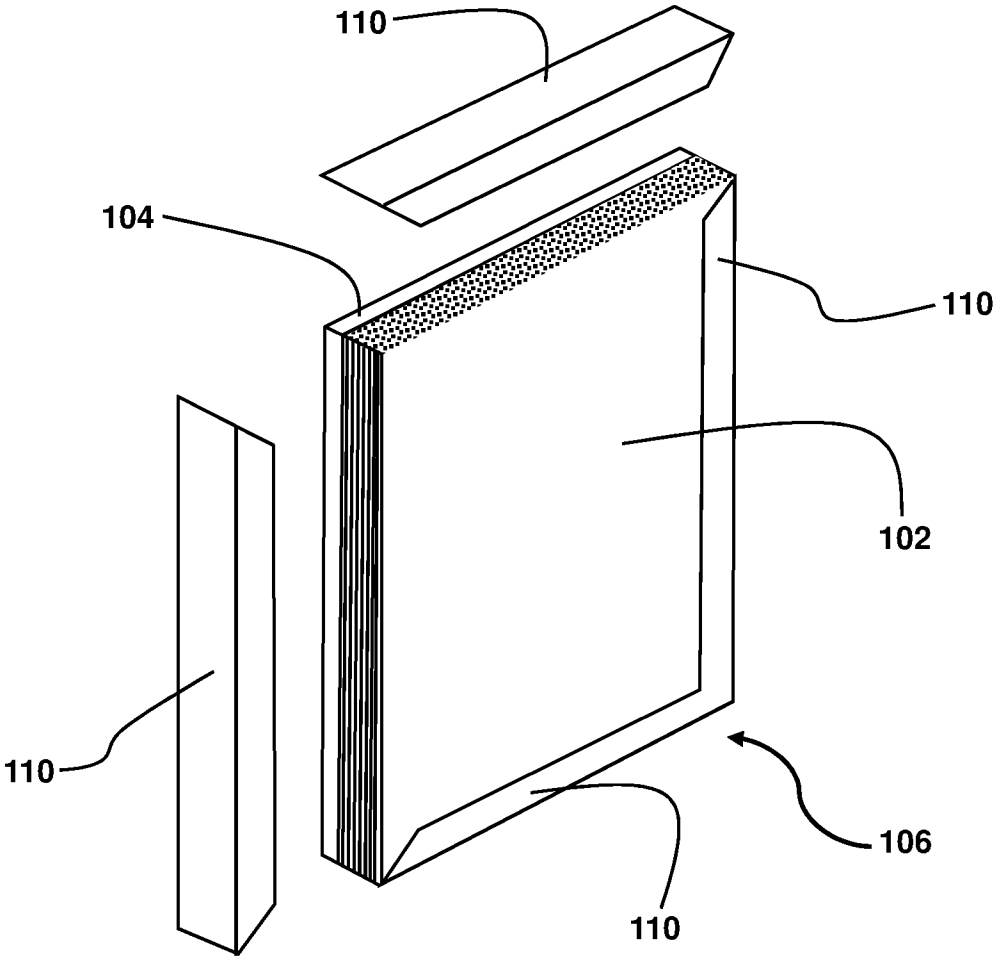
FIG. 9C is a partially exploded view of the frame containing the energy-absorbing layers and spall-mitigating panel, according to an embodiment herein.

As shown in FIG. 7, with reference to FIGS. 1 through 6, the frame 106 comprises an approximately U-shaped cross section formed by approximately parallel lateral walls 118, 120, each wall 118, 120 having an outer perimeter, and a bottom plate 122 extending generally perpendicularly to the lateral walls 118, 120, and wherein the plurality of energy-absorbing layers 102 and the spall-mitigating panel 104 are positioned in between the lateral walls 118, 120. In FIGS. 7 and 8, with reference to FIGS. 1 through 6, the frame 106 comprises frame members 110, which all have an approximately U-shaped cross-section formed by approximately parallel lateral walls 118, 120, each having an outer perimeter, and a bottom plate 122 extending generally perpendicularly to the lateral walls 118, 120 between the outer perimeters of the lateral walls 118, 120. FIGS. 9A through 9B, with reference to FIGS. 1 through 8, illustrate perspective views of the frame 106 with the energy-absorbing layer 102 and spall-mitigating panel 104 installed therein and with respect to the first opening 126 and second opening 128. FIG. 9C, with reference to FIGS. 1 through 9B, is a partially exploded view of the frame 106 containing the energy-absorbing layers 102 and spall-mitigating panel 104, along with the frame members 110 surrounding the layers 102 and panel 104.

An exemplary embodiment of the cassette 100 is comprised of a plurality of (e.g., eight, for example) layers 102 of high temperature energy absorbing elastomer capped with a half inch thick panel or layer 104 comprising KEVLAR® material, for example, assembled in a U-channel "cassette" frame 106 to form the cassette 100 to line internal ammunition compartment volume of the ammunition compartment 101. The frame 106 may comprise 14-16 gauge steel, in one example. The cassette 100 is configured to mitigate overmatching shaped-charge threats, as described herein.

Upon overmatching threat penetration to the ammunition compartment, the cassette 100 as positioned within the ammunition compartment 101, mitigates spall propagation, dampens and captures ricochet fragmentation internal to the compartment, and absorbs energy resulting in improved ammunition, vehicle, and crew or occupant survivability.

The cassette 100 mitigates spall propagation. Upon ballistic threat penetration to the ammunition compartment structure 101, the main penetrator, channel material, backface material, and eroded penetrator material enter the compartment 101 impacting and initiating or igniting stowed ammunition 103). The ensuing energy release, or explosion, imparts substantial loading on the ammunition compartment structure often resulting in mechanical failure. The embodiment 100 reduces the dispersion of spall fragments by offering resistance through a stack of layers 102 acting as a loosely packed curtain ply capped with a panel 104. In one example, the layers 102 may comprise eight ⅛-inch thickness energy absorbing rubber layers 102. The panel 104 may comprise ½-inch thick KEVLAR® material. These materials strip-out some, but not all, of the spall fragments entering the ammunition compartment volume.

The cassette 100 dampens and captures ricochet of fragments 105. In the confines of an ammunition compartment 101, it has been experimentally determined that there is substantial fragment ricochet damage galling the interior ammunition compartment walls 115. Conventionally, these ricochet fragmentation 105 could re-enter the compartment volume returning back to intact stowed ammunition 103 causing additional stowed ammunition reaction and fires. However, the cassette 100 provided by the embodiments herein protect stowed ammunition 103 from ricochet fragmentation 105 through damping and capturing of the ricochet fragmentation 105. When the ammunition compartment 101 is penetrated by a shaped-charge jet or a penetrator, some fragments will penetrate the panel 104 and the layers 102. As the fragments impact the interior walls 115, they may ricochet back into the layers 102. The layers 102 absorb ricochet fragment energy as the ricochet fragment 105 pulls on each ply of the plurality of layers 102 as a series of "loose curtains" until captured within the stack of layers 102.

In this regard, the cassette 100 absorbs energy. As the stowed ammunition 103 responds to the ballistic insults and contained energetics ignite, gaseous combustion products are generated from the energetic reaction at high rates. The gaseous product generation results in an increased pressure environment internal to the ammunition compartment 101. Energy absorbing polymer material such as rubber in the layers 102 receives the first-order shock wave typically incident on the inner surfaces 115 allowing for a lengthened application on the interior surfaces 115; hence, mitigating the initial shock loading to the structure of the compartment 101 while improving structural survivability.

Accordingly, the embodiments herein offer a departure from the configurations and functionalities of conventional ammunition compartments, which offer no specific means to capture ricochet, absorb energy, and mitigate spall fragment effects internal to the compartment Potential uses for the cassette 100 include military platforms containing stowed ammunition to perform combat and logistics operations in hostile environments, ground combat vehicles, logistic systems, aircraft, and naval platforms. The cassette 100 may also be applied to logistic systems; e.g., transport vehicles, heavy haulers, trailers, and shipping containers. The cassette 100 may also be applied to naval vessels with stowed ammunition. Furthermore, any commercial ground vehicle, aircraft, ship, rail car, and logistics container stowing ammunition behind armor may also benefit from the cassette 100.

Each of the cassette 100 and frame 106 may be assembled using any suitable manufacturing technique such as, for example, by using Tungsten Inert Gas (TIG) welding techniques. The cassette 100 was tested in verification tests as discussed below. Prototypes of cassettes 100 were fabricated for proof-of-principle verification tests with a circular pressure gauge port (not shown) for instrumentation purposes. Production cassettes 100 do not need or have the pressure gauge port.

Test Results: The effectiveness of the cassette 100 was experimentally verified quantifying improved ammunition survivability and reductions in stowed ammunition response via side-by-side comparative tests (without cassette 100, then with cassette 100). In summary, all ammunition 103 without the cassette 100 lining the ammunition compartment 101 initiated and were destroyed realizing a 0% survival rate when subjected to an overmatching shaped charge threat. Ammunition 103 protected by the cassette 100 lining the interior surfaces 115 of the ammunition compartment 101 realized a 62.5% survival rate; a marked improvement in the survivability of the ammunition 103.

Figure 10:
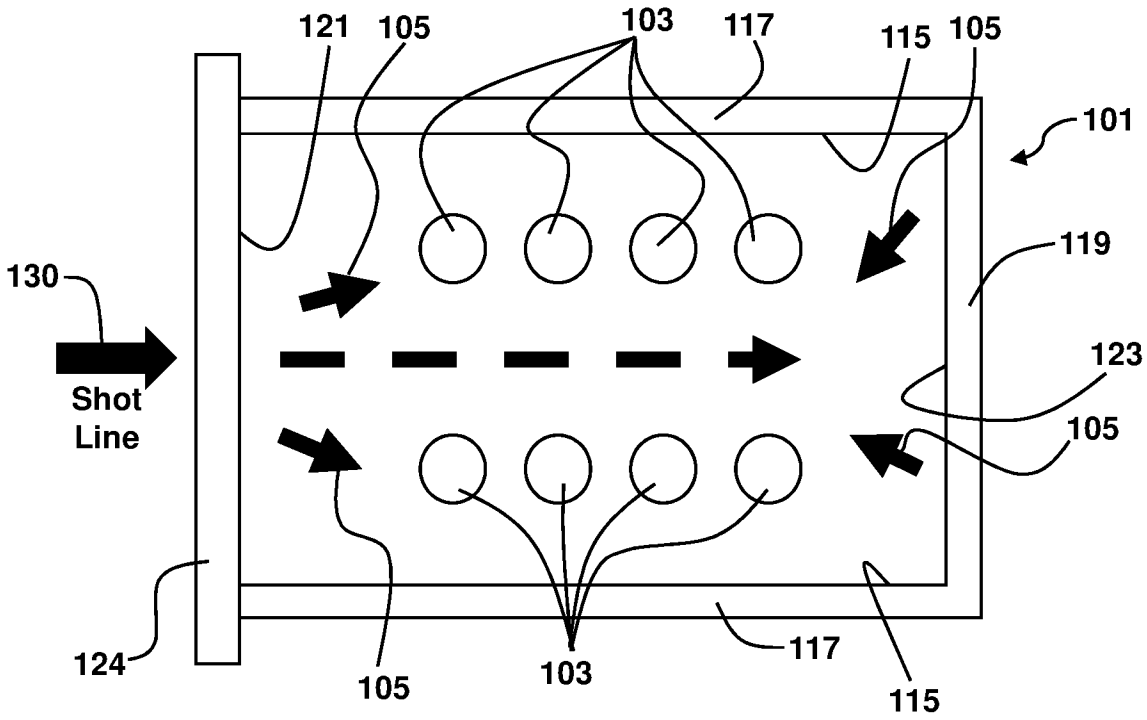
FIG. 10 is a schematic diagram of the ammunition compartment without the energy-absorbing layer or spall-mitigating panel, according to an embodiment herein.

External armor 124, shown in FIG. 10, with reference to FIGS. 1 through 9C provides a ballistic resistance by removing energy from the penetrator 130 and causing erosion/break-up of the penetrator 130. This reduces energy applied to and entering the compartment 101 and the compartmented ammunition 103. Examples of external armor 124 which may be used include Rolled homogeneous armor (RHA), ceramics, composites, and explosive reactive armor.

The energy absorbing polymer, such as the layer 102, absorbs spall fragments impacting the side walls 117 and back face 119 of the compartment 101, which is the interior surface of the compartment 101 facing the wall 121 of the compartment 101 initially impacted by the penetrator 130, thus mitigating ricochet. Ricochet fragments 105 are found to be significant contributors to the destruction of compartmented ammunition 103 as shown by experiments using witness or inert receptors. Examples of suitable energy-absorbing material include high molecular weight polyethylene and extreme temperature silicone rubber.

Figure 11:
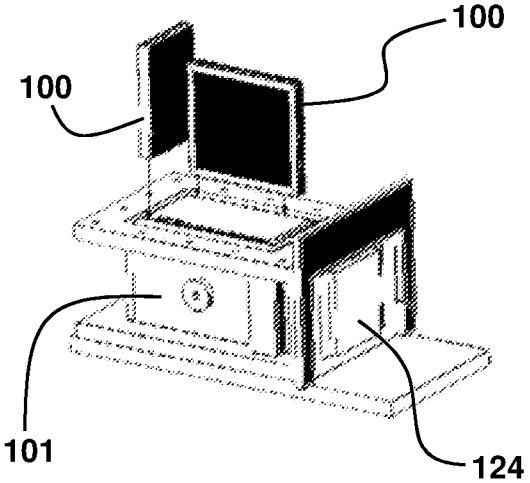
FIG. 11 is a perspective view showing the installation of the energy-absorbing layers and spall-mitigating panel in an ammunition compartment, according to an embodiment herein.

FIG. 11, with reference to FIGS. 1 through 10, illustrates an example of an experimental ammunition compartment 101. The ammunition compartment 101 used for the experimentation was 20 inches in length, 10 inches in width, and 15 inches in height. For the experimental testing, four cassettes 100 were fabricated in two sizes. One size, referred to as type 1, was intended to cover the shorter vertical walls of the ammunition compartment 101. The second size, referred to as type 2, was intended to cover the longer vertical walls of the ammunition compartment 101 extending between the two type 1 cassettes covering the shorter vertical walls. In an example, the ammunition compartment 101 may utilize six cassettes 100 to line or cover all six internal surfaces 115 of the ammunition compartment 101.

As shown in FIGS. 2 and 6, the energy-absorption and spall-mitigation cassette 100 may also include at least one air gap 108 between the energy-absorbing polymer layer 102 and the spall-mitigation panel 104. The air gap 108 allows spall fragments to extend their conical trajectories; i.e., spread out more, before impacting the spall-mitigation panel 104; thus, increasing the effective surface area for capture of the fragments by the spall-mitigating panel 104. As the area widens, the specific energy or the energy per unit area is reduced on the spall-mitigation providing for a more effective reduction in spall impacts. The air gap 8 may be configured as a 1-inch gap, for example, according to some embodiments herein.

The spall-mitigation panel 104 may be, for example, a layer of composite armor. The spall-mitigation panel 104 is configured to reduce the number of fragments, from direct shaped-charge jet or penetrator interaction with the external armor 124, entering the compartment 101 containing the ammunition 103 and to reduce the number of ricochet fragments 105, which have had their energy reduced and less concentrated through interaction with the energy-absorbing polymer layer 102 and the air gap 108, re-entering the compartment 101 containing the ammunition 103.

The composite armor for the spall-mitigation panel 104 may be a woven laminate of aramid yarn in a ceramic, including thermoplastic and thermosetting polymer, or resin matrix. "Aramid" is the shortened form of "aromatic polyamide." Examples of suitable fibers, yarns, or fabrics are KEVLAR® material, in particular KEVLAR® K29, TWARON®, and NOMEX® materials. In one exemplary embodiment, laminated woven fabric of KEVLAR® K29 available from E. I. du Pont de Nemours and Company, Delaware, USA, which is a para-aramid with the chemical name of poly(para-phenylene terephthalamide) embedded in a polyvinyl butyral (PVB) phenolic resin matrix may be used for the panel 104.

The cassette 100 is provided with a cascade or stack of energy-absorbing polymer layers or panels 102. In an example, eight energy-absorbing polymer layers 102 are provided. Each of the energy-absorbing polymer layers 102 may be about ⅛ inch thick and may be made of extreme temperature rubber. In other examples, the energy-absorbing polymer layers 102 may be fiber, yarn, or weave reinforced.

The air gaps 108 may be configured between the energy-absorbing polymer layers 102 themselves or between the energy-absorbing polymer layers 102 and the panel 104. The energy-absorbing polymer layers 102 are loosely held in the frame 106 such that the energy-absorbing polymer layers 102 behave as a "loose curtain" to drag and pull energy from the spall fragments. In an example, the panel 104 has a thickness of about ½ inch.

A plurality of spall-mitigation and ricochet-energy-absorbing cassettes 100 may be inserted into the ammunition compartment 101 of the test rig 107. In an example, four cassettes 100 are used to line the interior surfaces 115 of the ammunition compartment 101. In other examples, six cassettes 100 may be used to line all interior surfaces 115 of the ammunition compartment 101.

The cassette 100 includes a "window frame" like structure 106, and in one example may be made of 1/16-inch mild steel U-shaped channels. The cassettes 100 fabricated for testing included two type 1 and two type 2 cassettes. The external dimensions of the two type 1 cassettes were 14¾ inch by 9¾ inch. The type 1 cassettes lined the shorter vertical sides of the ammunition compartment 101. The external dimensions of the two type 2 cassettes were 14¾ inch by 16½ inch. The type 2 cassettes lined the longer vertical sides of the ammunition compartment 101. The type 2 cassettes were each shorter than the length of the longer sides of the ammunition compartment 101 by the combined thicknesses of the type 1 cassettes. Both types of cassettes had the same thickness in the experimental fabrication. In an example, the cassettes 100 may comprise an overall or outside thickness of 1.75 inches. In an example, the cassettes 100 may have an inside thickness of 1.625 inches. The panel 104 may have a thickness of ½ inch.

As described with respect to FIGS. 7 and 8, the frame 106 may comprise a plurality of frame members 110 each of which may be made of a length of mild-steel U-shaped channels. The ends 112 of each frame member 110 may be cut at a 45° angle to permit proper joining of the individual frame members 110 to create the frame 106. The ends 112 of the frame members 110 may be joined together by welding to form a quadrilateral frame 106, such as a square or a rectangle, in some examples. The joints (not shown) between the ends 112 of the frame members 110 may be formed by forming a weld bead along all three sides of the frame members 110. The completed frame 106 has openings 126, 128 on either side of the frame 106 that are spaced apart by the inside thickness of the frame 106. In an example, the frame members 110 may have a depth of about 0.9375 inch that may receive portions of the energy-absorbing elastomer layers 102 and the panel 104. The frame members 110 may have an overall exterior height of about one inch, in an example.

In the fully assembled cassette 100, the panel 104 is positioned against the lateral sides of the frame members 110 that define the opening 128, such that the panel 104 is positioned adjacent to the opening 128. The energy-absorbing elastomer layer 102 is positioned against the lateral sides of the frame members 110 that define the opening 126, such that the energy-absorbing elastomer layer 102 is positioned adjacent to the opening 126. There may be a 1/64th inch air gap 108 between the energy-absorbing elastomer layers 102 and between the panel 104 and the energy-absorbing elastomer layer 102 nearest the panel 104. The cassette 100 is installed against the interior surface 115 of a wall of the ammunition compartment 101, which may same a common structure as the exterior armor 124 of the ammunition compartment 101, with the panel 104 facing toward the interior of the ammunition compartment 101.

In an example implementation, the cassette 100 is an energy absorbing and spall mitigating cassette liner system or, more briefly, a cassette 100 that may be applied to the interior surfaces of a combat vehicle ammunition compartment. The cassettes 100 are integrated to the ammunition compartment 101 with a KEVLAR® surface of the panel 104 facing the interior of the ammunition compartment 101.

In operation, as the overmatching threat munition 130 penetrates the exterior armor 124, the stack of eight (for example) extreme temperature, energy-absorbing elastomer or rubber layers 102 allows initial spall fragments to spread in a conical pattern. Next, some spall fragments 105 will be absorbed by the panel 104. The continuing penetrator 130 and spall fragments 105 will travel through the compartment 101 impacting both stowed ammunition 103 and cassettes 100 lining the interior surfaces 115 of the ammunition compartment 101. The residual spall impacting cassettes 100 will now be absorbed by the panel 104 and the energy absorbing rubber layers 102. Some fragments 105 will penetrate the cassette 100 ricocheting off the back face 123 of the compartment 101, which is the interior surface of the compartment 110 opposite the surface 121 through which the penetrator 130 entered the compartment 110. The spall fragments 105 will return into the layers 102, which behaves as a "loose curtain" to drag and pull energy from returning spall fragments 105. These effects culminate in a reduced ammunition response; i.e. fewer live rounds of ammunition 103 within the compartment 101 will ignite, and a reduced mechanical effect on the interior compartment surfaces 115, 121, 123 thus increasing the structural survivability of the ammunition compartment 101 and the vehicle (not shown) attached thereto. In the absence of the cassettes 100, the spall fragments 105 would ricochet back into the compartment 110 damaging and igniting a greater number of the stowed ammunition 103.

The embodiments herein increase ammunition survivability by absorbing and eliminating fragment ricochet internal to the ammunition compartment 101 upon overmatching threat penetration by a penetrator 130. The layered energy absorbing elastomer layers 102 coupled with spall mitigation panels 104 are configured to reduce spall, capture ricochet, absorb energy, and mitigate fragments 105 returning to the ammunition compartment 101 and subsequently impacting stowed ammunition 103. The layered energy-absorbing elastomer layers 102 behave with a "curtain" effect transferring ricochet spall fragment kinetic energy, and thus the spall fragment velocity, to work performed by the fragment 105 in displacing each layer 102 ultimately reducing the quantity of ricochet fragments 105 returning to the ammunition compartment 101 and impacting stowed ammunition 103. The embodiments herein do not simply rely on anti-fratricide techniques to mitigate round-to-round propagation.

Figure 12:
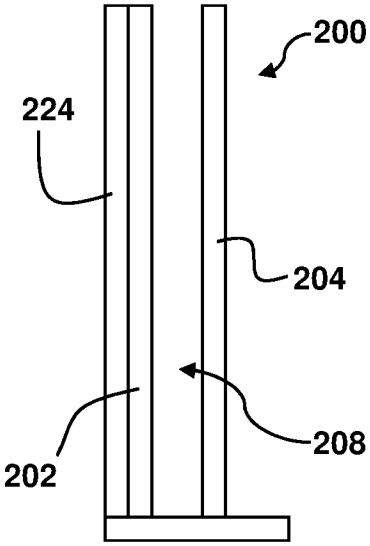
FIG. 12 is a schematic diagram of the energy-absorbing layers and spall-mitigating panel, according to another embodiment herein.

In FIG. 12, with reference to FIGS. 1 through 11, a second embodiment of a system 200 is provided. The exterior armor 224 forms the walls of the ammunition compartment 101. The material of the exterior armor 224 is similar to the exterior arm 24 of the first embodiment. An energy-absorbing layer 202 lines the interior surface of the exterior armor 224. A spall-mitigating, composite armor panel 204 is located inward of the energy-absorbing layer 202 in the interior of the ammunition compartment 101 such that the energy-absorbing layer 202 is located in between the exterior armor 224 and the composite armor panel 204. An air gap 208 of about one inch, for example, separates the energy-absorbing layer 202 and the composite armor panel 204.

The foregoing description of the specific embodiments will so fully reveal the general nature of the embodiments herein that others may, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein may be practiced with modification within the spirit and scope of the appended claims.

What is claimed is:

1. An ammunition storage compartment comprising:

a plurality of connected walls defining an interior region to store ammunition, wherein at least one of the walls comprises:

an outer armor plate having an outer surface and an inner surface;

a layer of high molecular weight polyethylene and a layer of extreme temperature silicone rubber located proximate the inner surface of the armor plate in the interior region;

a spall-mitigating panel located inward of the layer of energy absorbing material in the interior region; and one air gap in between the layer of high molecular weight polyethylene and the layer of extreme temperature silicone rubber and the spall-mitigating panel wherein the spall-mitigating panel comprises a plate comprising any of an aramid woven fabric and woven laminate encased in a resin.

2. The ammunition storage compartment of claim 1, wherein one layer of high molecular weight polyethylene and rubber comprises one of a plurality of high molecular weight polyethylene and rubber layers provided in between the spall-mitigating panel and the inner surface of the outer armor plate.

3. The ammunition storage compartment of claim 2, wherein the one air gap is positioned in between one of the plurality of high molecular weight polyethylene and rubber layers and another panel selected from the plurality of high molecular weight polyethylene and rubber layers and the spall-mitigating panel.

4. The ammunition storage compartment of claim 2, wherein the one air gap comprises one of a plurality of air gaps, wherein a respective one of the plurality of air gaps is positioned in between each of the plurality of high molecular weight polyethylene and rubber layers and a neighboring one of the plurality of high molecular weight polyethylene and rubber and in between the spall-mitigating panel and one of the plurality of high molecular weight polyethylene and rubber neighboring the spall-mitigating panel.

* * * * *